United States Patent [19]

Balland

[11] Patent Number: 4,589,682

[45] Date of Patent: May 20, 1986

[54] MOBILE BINDING

[76] Inventor: Francois Balland, 8 rue des Volontaires, 80500 Mont Didier, France

[21] Appl. No.: 755,715

[22] Filed: Jul. 16, 1985

[30] Foreign Application Priority Data

Jul. 20, 1984 [FR] France ..... 84 11832

[51] Int. Cl.[4] ..... B42D 17/00

[52] U.S. Cl. ..... 281/46; 281/42

[58] Field of Search ..... 281/42, 45, 46, 47, 281/48, 49, 50

[56] References Cited

U.S. PATENT DOCUMENTS 3,596,928 8/1971 Edmonds ..... 281/46
3,950,012 4/1976 Donovan ..... 281/46

FOREIGN PATENT DOCUMENTS 876390 5/1953 Fed. Rep. of Germany ..... 281/46
647198 11/1928 France ..... 281/46
1249226 10/1971 United Kingdom ..... 281/46
1367106 9/1974 United Kingdom ..... 281/46

*Primary Examiner*—Paul A. Bell
*Attorney, Agent, or Firm*—Young & Thompson

[57] ABSTRACT

A mobile binding is provided comprising holding elements or S shaped clips and formed from two sheets of cardboard, or a similar semi rigid material, which extends over the whole length of the binding and which are bonded together, except at least in the end portions of the back, the inner sheet having an opening in which one of the end legs of the S shaped element may be engaged, the other end then being engaged in the middle of a review to be bound. The improvement consists in providing said holding elements with a notch on the inner face of their portion situated opposite said opening when they are in position in the binding; it also comprises a plate which may be engaged in said opening between said two sheets of the back and which is provided with an outwardly turned flange adapted for engagement in the notches of said elements.

3 Claims, 5 Drawing Figures

MOBILE BINDING

BACKGROUND OF THE INVENTION

In so called mobile bindings which are intended to hold a series of reviews together, these latter may be held in position by S shaped elements one leg of which is engaged in the central fold of a review, the other leg being fixed to the back of the review.

Some mobile bindings comprising S shaped holding elements are formed from two sheets of cardboard, or a similar semi rigid material, which extend over the whole length of the binding and which are bonded one to the other, except at least in the end portions of the back, the inner sheet having an opening in which one of the end legs of the S shaped element may be engaged, the other end being then engaged in the middle of a review to be bound.

Experience has shown that, when the binding comprises a relatively large number of reviews, the inner sheet of the back moves away from the outer sheet and the holding elements risk breaking loose from the binding.

The present invention provides then a mobile binding of the above type improved so as to overcome this drawback.

SUMMARY OF THE INVENTION

The binding of the invention is characterized in that the holding elements are provided with a notch on the internal face of their portion situated opposite the opening when they are in position in the binding, and it further comprises a plate which may be engaged in the opening between the two sheets of the back and which has a flange adapted for engagement in the notches of the elements. The holding elements are thus immobilized and cannot slide accidently.

Furthermore, when the back is curved, the plate is curved to the profile of the back and prevents the back from being flattened under the effect of the weight of the reviews.

BRIEF DESCRIPTION OF THE DRAWINGS

One embodiment of the binding of the present invention is described hereafter by way of non limitative xample with reference to the accompanying drawings in which.

DESCRIPTION OF THE PREFERRED EMBODIMENT

Figure 1:
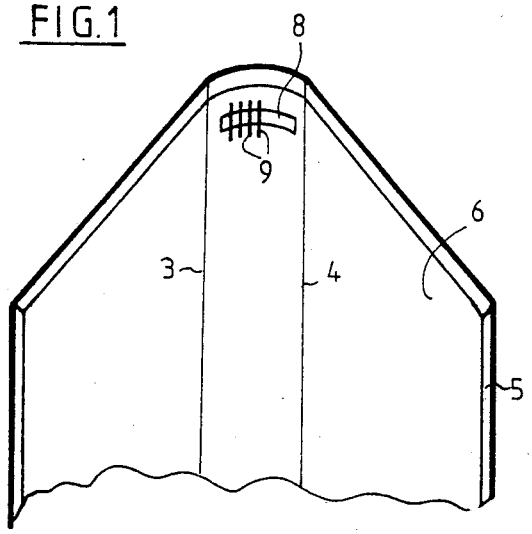
FIG. 1 is a perspective view showing one of the ends of the opening binding.

Such as shown in the drawings, the mobile binding of the invention is formed from two sheets 1 and 2, made from cardboard or a similar semi rigid material, which are superimposed and in which fold lines 3 and 4 are formed. The external cardboard sheet 1 is covered with a decorative sheet 5 whereas the internal sheet 2 is covered with an end paper 6. The two sheets 1 and 2 are bonded to each other on the outside of lines 3 and 4, but not in their part 7 between these lines, which is curved when hot and is intended to form the back of the binding. The end paper 6 extends over the whole width of the binding and the decorative sheet 5 comprises folds which cover the edges of sheets 1 and 2.

A substantially rectangular opening 8 is formed in the cardboard sheet 2 and in the end paper 6 which covers it, in the vicinity of each of the ends of part 7.

The binding is associated with holding elements or clips which may be engaged in openings 8.

Figure 2:
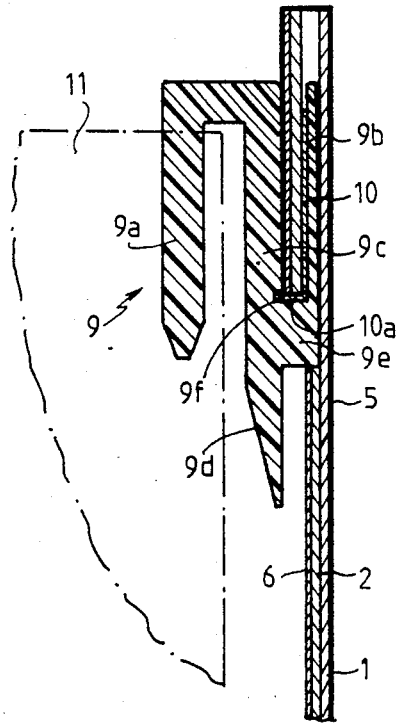
FIG. 2 is a sectional view, on a larger scale, of a detail of this binding.
Figure 3:
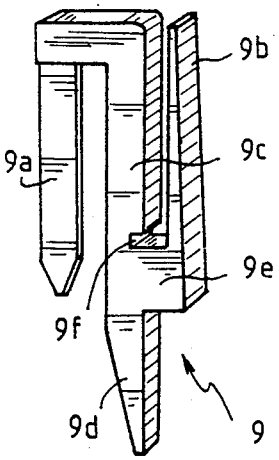
FIG. 3 is a perspective view of a holding element.
Figure 4:
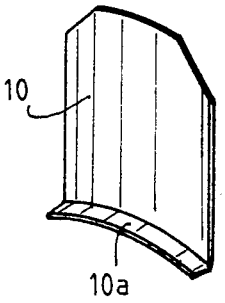
FIG. 4 is a perspective view of the plate.

In the embodiment shown in FIGS. 2 and 3, each clip 9 is made from a molded plastic material. It is approximately in the form of an S. One **9*a* of its external legs is relatively thin and disposed in the plane of the clip. Its other external leg 9*b* is also relatively thin; but it is disposed in a plane perpendicular to that of the clip, and can be seen in FIG. 3. Its central leg 9*c* is extended by a nose 9*d*, beyond the position 9*e* where it is connected to leg 9*b*. The ends of leg 9*a* and of nose 9*d* are tapered; leg 9*b* has a bevelled longitudinal section. A Notch 9*f* is provided on the internal face of the central leg 9*c*, above position 9*e*. Each opening 8 has a height a little greater than that of part 9*e*** of the clip.

Two plates 10 are furthermore provided whose width is substantially that of the back and has the same curvature as it. Each comprises at its base a flange **10*a* which may be engaged in the notch 9*f* of a clip 9. These plates 10 are previously engaged respectively in the upper opening 8 and the lower opening 8, between sheets 1 and 2, until their flange 10*a* is practically in contact with the edge of opening 8** the furthest away from the middle of the binding.

For positioning a clip, it is sufficient to engage its leg **9*b* through one of the openings 8, for example the upper opening 8, between the two sheets 1 and 2, until the flange 10*a* of the plate is engaged in its notch 9*f* (see FIG. 2**).

For fixing a review 11 in the binding, a clip 9 is positioned in each of the openings 8 and legs **9*a* of the two clips are engaged in the middle of the review 11. The branches 9*a*** which are thin and are disposed in the plane of the review only slightly increase the thickness of this review.

Since clips 9 are clipped to plates 10 they cannot move out of openings 8. In addition, these plates maintain the curved shape of back 7.

Figure 5:
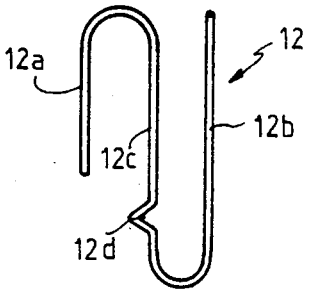
FIG. 5 is a perspective view of another holding element.

In the embodiment shown in FIG. 5, clip 12 is formed by a wire or metal rod bent into an S shape, its legs **12*a* and 12*b* being intended to be inserted respectively in the middle of a review 11 and between the two sheets 1 and 2 of the binding. Its central leg 12*c* comprises, at a short distance from its connection with leg 12*b*, a double bend portion 12*d* forming a notch turned towards leg 12*b***.

This clip is used like clip 9. When leg **12*b* is positioned between the two sheets 1 and 2, it is locked in position by engagement of flange 10*a* of plate 10 in its notch 12*d***.

It goes without saying that the present invention should not be considered as limited to the embodiment described and shown, but covers on the contrary, all variants thereof.

What is claimed is:

1. In a mobile binding comprising holding elements or S shaped clips and formed from two sheets 1 and 2 made from cardboard, or a similar semi rigid material, which extend over the whole length of the binding and which are bonded together, except at least in the end portions of the back, the inner sheet having an opening 8 in which one of the end legs of the S shaped element may be engaged, the other end being then engaged in the middle of the review to be bound, said holding elements are provided with a notch on the inner face of their part situated opposite the opening when they are in position in the binding, and it further comprises a plate which may be engaged in the opening between the two sheets of the back and which is provided with an outwardly turned flange adapted for engagement in the notches of said elements.

2. The binding as claimed in claim 1, wherein said holding elements 9 are made from a molded plastic material.

3. The binding as claimed in claim 1, wherein said holding elements are formed by a bent metal rod.

* * * * *